US005655303A

United States Patent [19]

Janczak

[11] Patent Number: 5,655,303

[45] Date of Patent: Aug. 12, 1997

[54] BABY FEEDING SYSTEM

[76] Inventor: Christopher Janczak, 141 Crooked, King of Prussia, Pa. 19406

[21] Appl. No.: 662,230

[22] Filed: Jun. 14, 1996

[51] Int. Cl.[6] ..... A47J 43/28

[52] U.S. Cl. ..... 30/326; 30/324; 446/71

[58] Field of Search ..... 30/151, 142, 143, 30/324, 326; 446/71

[56] References Cited

U.S. PATENT DOCUMENTS

| | | | |
|---|---|---|---|
| 1,544,267 | 6/1925 | Munson | 446/71 |
| 2,787,055 | 4/1957 | Wertz | 30/324 |
| 2,889,624 | 6/1959 | McDonald | 30/324 |
| 3,968,591 | 7/1976 | Pearson, Jr. | 30/324 |
| 4,719,702 | 1/1988 | Hoffman | 30/326 |
| 4,779,344 | 10/1988 | Panisch | 30/326 |

*Primary Examiner*—Hwei-Siu Payer

[57] ABSTRACT

A new Baby Feeding System for minimizing the time for feeding a child by utilizing molded shapes which represent objects that the child enjoys, retracting apart exposing an extendible eating utensil carrying food for the child; then extending the eating utensil presenting the food while the child remains interested. The inventive device includes a molded shape, the molded shape comprises an upper portion and a lower portion, a hollow support tube, a grooved extending rod slidably projecting within the tube, a pair of opening gears securing the upper and lower portion of the molded shape and mechanically engage the grooved extending rod, a finger handle member secured to the tube, and an expandable receiving sleeve secured to the grooved extending rod. The expandable receiving sleeve removable captures a utensil shaft for securing the utensil attachment.

6 Claims, 3 Drawing Sheets

BABY FEEDING SYSTEM

BACKGROUND OF THE INVENTION

1. Field of the Invention

The present invention relates to Infant Feeding Devices and more particularly pertains to a new Baby Feeding System for minimizing the time for feeding a child by utilizing molded shapes which represent objects that the child enjoys, retracting apart exposing an extendible eating utensil Carrying food for the child; then extending the eating utensil presenting the food while the child remains interested.

2. Description of the Prior Art

The use of Infant Feeding Devices is known in the prior art. More specifically, Infant Feeding Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Infant Feeding Devises include U.S. Pat. Nos. 4,863,033, 3,968,591; U.S. Design Pat. Nos. 310,944, 302,091; U.S. Pat. No. 4,779,344 and U.S. Design Pat. No. 257,757.

While these devices fulfill their respective, particular objectives and requirements, the aforementioned patents do not disclose a new Baby Feeding System. The inventive device includes a molded shape, a molded shape opening means for opening the molded shape, a handle means for the user to hold the present invention, and a utensil coupling means for attaching an eating utensil.

In these respects, the Baby Feeding System according to the present invention substantially departs from the conventional concepts and designs of the prior art, and in so doing provides an apparatus primarily developed for the purpose of minimizing the time for feeding a child by utilizing molded shapes which represent objects that the child enjoys, retracting apart exposing an extendible eating utensil carrying food for the child; then extending the eating utensil presenting the food while the child remains interested.

SUMMARY OF THE INVENTION

In view of the foregoing disadvantages inherent in the known types of Infant Feeding Devices now present in the prior art, the present invention provides a new Baby Feeding System construction wherein the same can be utilized for minimizing the time for feeding a child by utilizing molded shapes which represent objects that the child enjoys, retracting apart exposing an extendible eating utensil carrying food for the child; then extending the eating utensil presenting the food while the child remains interested. The general purpose of the present invention, which will be described subsequently in greater detail, is to provide a new Baby Feeding System apparatus and method which has many of the advantages of the Infant Feeding Devices mentioned heretofore and many novel features that result in a new Baby Feeding System which is not anticipated, rendered obvious, suggested, or even implied by any of the prior art Infant Feeding Devices, either alone or in any combination thereof.

To attain this, the present invention generally comprises a molded shape, a molded shape opening means for opening the molded shape, a handle means for the user to hold the present invention, and a utensil coupling means for attaching an eating utensil.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Baby Feeding System apparatus and method which has many of the advantages of the Infant Feeding Devices mentioned heretofore and many novel features that result in a new Baby Feeding System which is not anticipated, rendered obvious, suggested, or even implied by any of the prior art Infant Feeding Devices, either alone or in any combination thereof.

It is another object of the present invention to provide a new Baby Feeding System which may be easily and efficiently manufactured and marketed.

It is a further object of the present invention to provide a new Baby Feeding System which is of a durable and reliable construction.

An even further object of the present invention is to provide a new Baby Feeding System which is susceptible of a low cost of manufacture with regard to both materials and labor, and which accordingly is then susceptible of low prices of sale to the consuming public, thereby making such Baby Feeding System economically available to the buying public.

Still yet another object of the present invention is to provide a new Baby Feeding System which provides in the apparatuses and methods of the prior art some of the advantages thereof, while simultaneously overcoming some of the disadvantages normally associated therewith.

Still another object of the present invention is to provide a new Baby Feeding System for minimizing the time for feeding a child by utilizing molded shapes which represent objects that the child enjoys, retracting apart exposing an extendible eating utensil carrying food for the child; then extending the eating utensil presenting the food while the child remains interested.

Yet another object of the present invention is to provide a new Baby Feeding System which includes a molded shape, a molded shape opening means for opening the molded shape, a handle means for the user to hold the present invention, and a utensil coupling means for attaching an eating utensil.

Even still another object of the present invention is to provide a new Baby Feeding System wherein the user is able to utilize the present invention to substantially decrease feeding time for a child.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
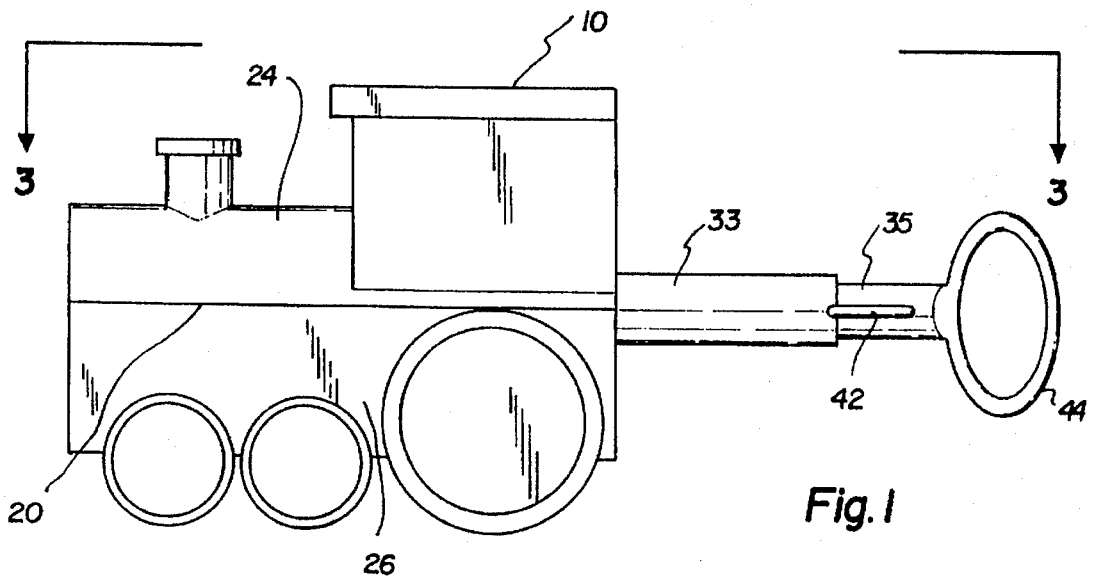
FIG. 1 is a side view of a new Baby Feeding System according to the present invention.
Figure 2:
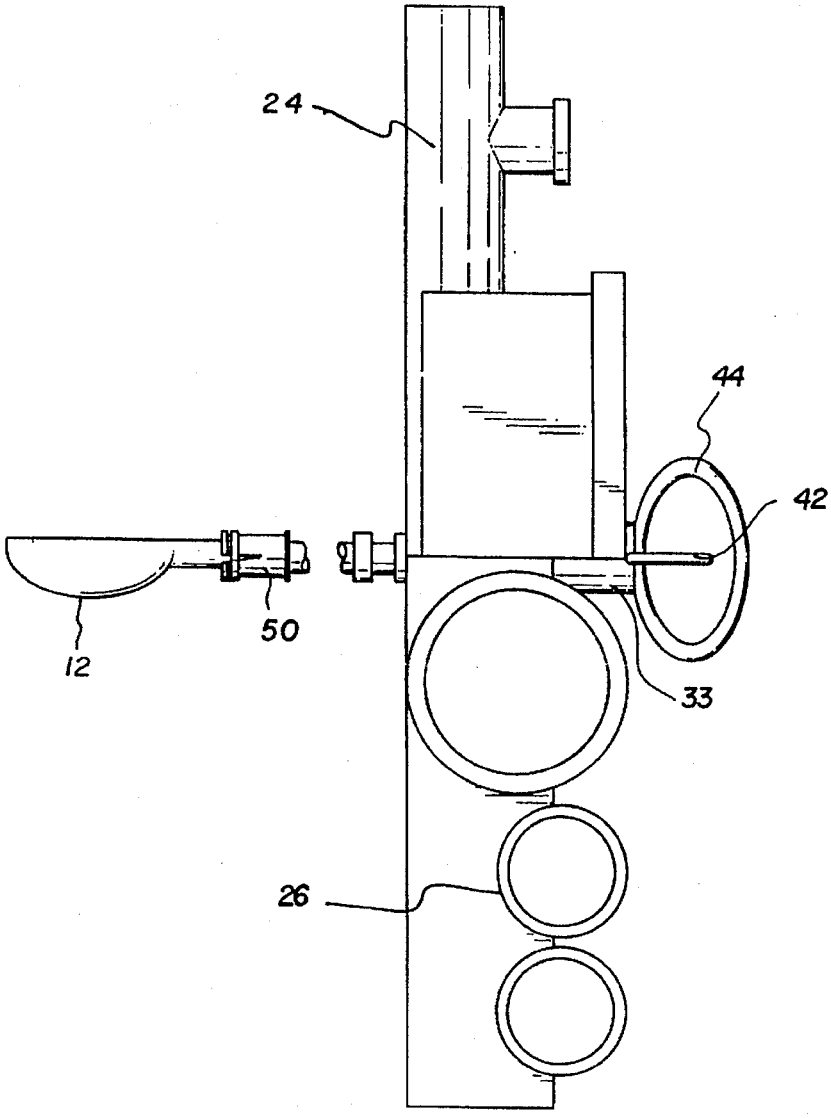
FIG. 2 is a side view with the molded shape opened.
Figure 3:
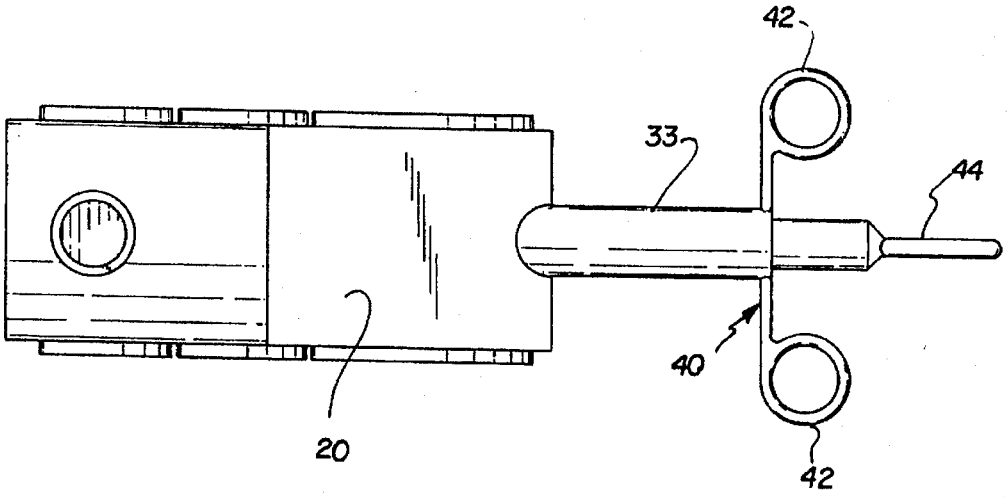
FIG. 3 is a top view of the present invention.
Figure 4:
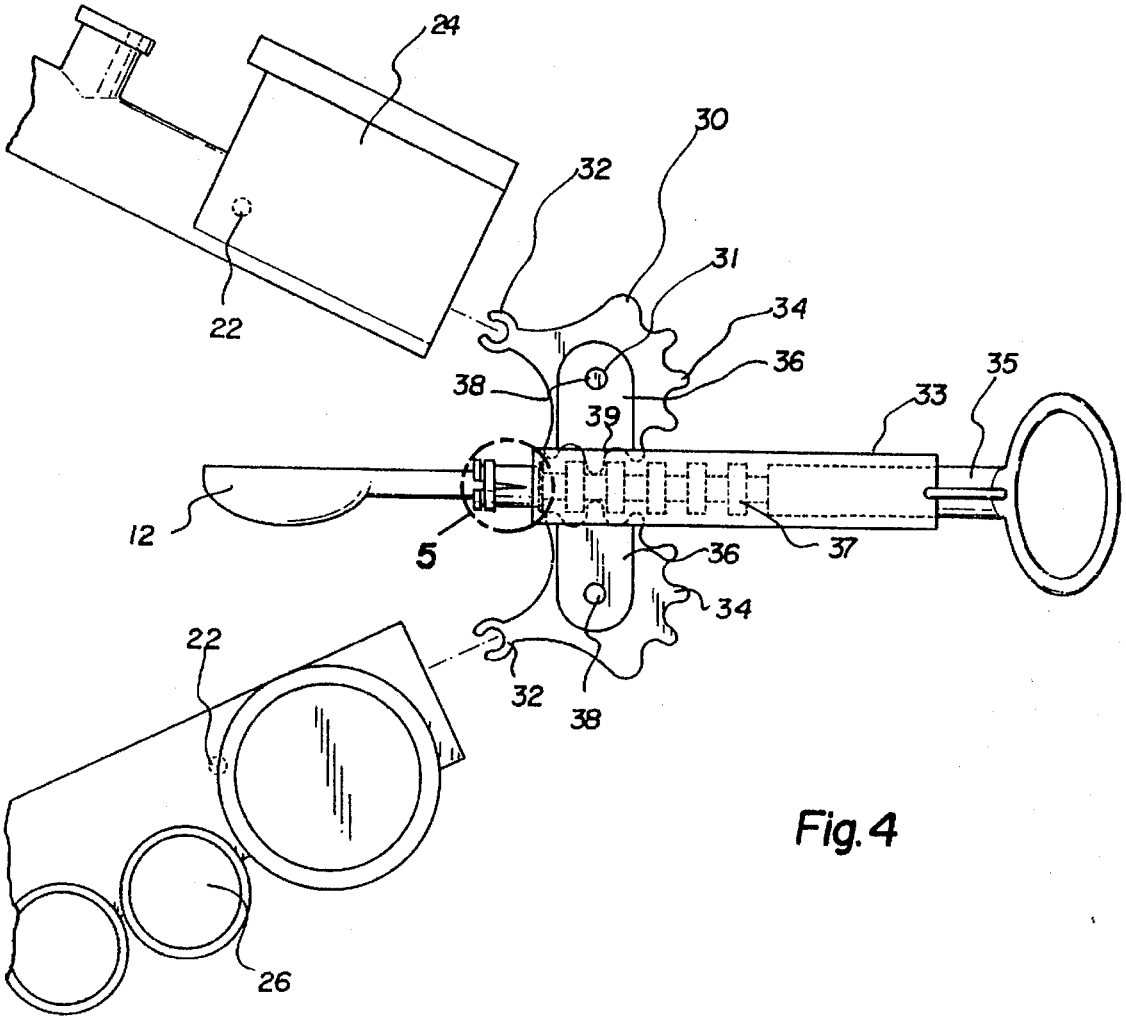
FIG. 4 is an exploded illustration of the invention.

With reference now to the drawings, and in particular to FIGS. 1–6 thereof, a new Baby Feeding System embodying the principles and concepts of the present invention and generally designated by the reference numeral 10 will be described.

More specifically, it will be noted that the Baby Feeding System 10 comprises a molded shape 20, a molded shape opening means 30 for opening of the molded shape 20, a handle means 40 attached to the molded shape opening means 30, a utensil coupling means 50 and a utensil attachment 12 secured by the utensil coupling means 50.

Figure 5:
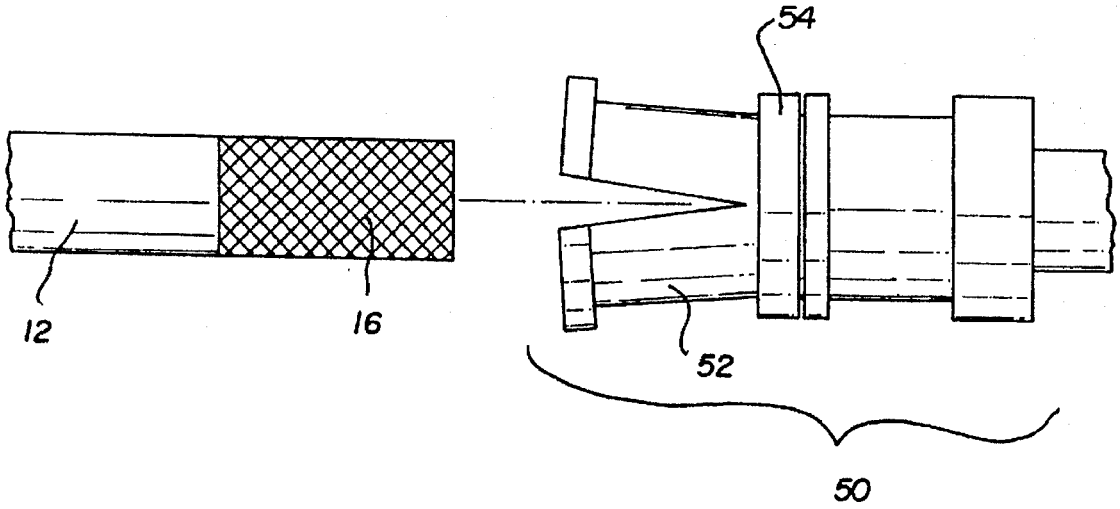
FIG. 5 is a side view focusing on the utensil coupling means from FIG. 4.
Figure 6:
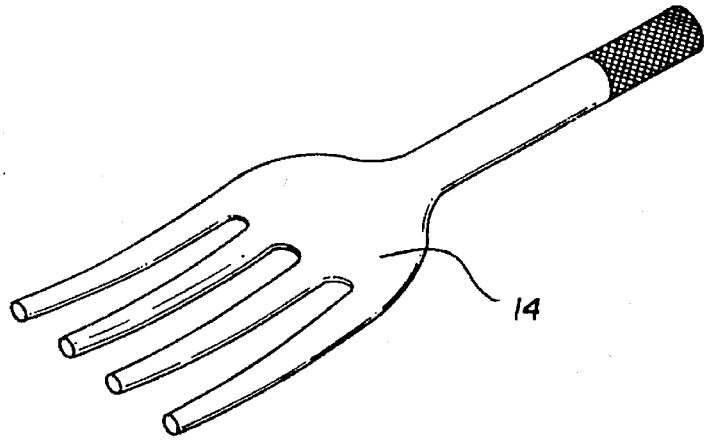
FIG. 6 is an illustration of a fork attachment.

FIGS. 1 through 6 illustrate a connecting shaft 22 attached from one side of the molded shape 20 to the opposite side. A finger handle member 42 attached to an end of a hollow support tube 33 allowing the user to insert fingers and a thumb handle member 44 mounted to an extending rod 35 where the opposite end of the extending rod 35 slidably projects through the center of the hollow support tube 33. At least one gear support member 36 is secured near the end of the hollow support tube 33 opposite of the handle means 40 comprising an opening means aperture 31 near the end opposite of the hollow support tube 33. The hollow support tube 33 includes at least one gear slot 39 near the end opposite of the handle means 40. At least one opening gear 34 is rotatably secured to the gear support member 36 by an opening gear pin 38 extending through the opening means aperture 31 engaging the opening gear 34, thereby extending partially through the gear slot 39. A grooved extending rod 37 is attached to the end of the extending rod 35 opposite of the thumb handle member 44 engaging the opening gear 34 to open and close the molded shape 20. At least one opening means clip 32 is secured to a protruding end of the opening gear 34 coupling to the connecting shaft 22 of the molded shape 20 allowing manipulation of the molded shape 20. An expandable receiving sleeve 52 is attached to the end of the grooved extending rod 37 opposite of the extending rod 35 allowing insertion of a utensil shaft 16. A slidable receiving sleeve constrictor 54 is slidably secured around the expandable receiving sleeve 52 which when slid over the expandable receiving sleeve 52 constricts the expandable receiving sleeve 52 thereby securing the utensil shaft 16 as shown in FIG. 5 of the drawings. In an alternative embodiment, the molded shape 20 comprises a molded upper shape 24 positioned opposite of a molded lower shape 26 so when juxtaposed the molded shape 20 is illustrated. FIG. 6 displays the utilization of a fork 14 in place of the spoon 12.

In use, the user engages the thumb handle member 44 thereby pushing forward forcing the grooved extending rod 37 to engage the opening gear 34 which opens the molded shape 20 disclosing the utensil attachment 12. The user is then able to insert the utensil attachment 12 into the mouth of the child while the child remains interested in the present invention.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Baby Feeding System comprising:

a molded shape;

a molded shape opening means for opening the molded shape;

a handle means attached to the molded shape opening means;

a utensil coupling means secured to the molded shape opening means opposite of the handle means; and a utensil attachment secured by the coupling means.

2. The Baby Feeding System of claim 1, wherein the molded shape includes a connecting shaft attached to one side of the molded shape extended to the opposite side thereof.

3. The Baby Feeding System of claim 2, wherein the handle means comprises a finger handle member attached to an end of a hollow support tube allowing a user to insert at least one finger and a thumb handle member mounted to one end of an extending rod where the opposite end of the extending rod projects through the center of the hollow support tube.

4. The Baby Feeding System of claim 3, wherein the molded shape opening means comprises:

at least one gear support member secured near the end of the hollow support tube opposite of the handle means and including an opening means aperture near the end opposite of the hollow support tube;

the hollow support tube comprising at least one gear slot near the end opposite of the handle means;

at least one opening gear rotatably secured to the gear support member by an opening gear pin extending through the opening means aperture engaging the opening gear, thereby extending partially through the gear slot;

a grooved extending rod secured to the end of the extending rod opposite of the thumb handle member and engaging the opening gear; and at least one opening means clip secured to a protruding end of the opening gear and coupled to the connecting shaft of the molded shape.

5. The Baby Feeding System of claim 4, wherein the utensil coupling means comprises an expandable receiving sleeve attached to the end of the grooved extending rod opposite of the extending rod and allowing insertion of a utensil shaft and further comprises a slidable receiving sleeve constrictor which when slid over the expandable receiving sleeve constricts the expandable receiving sleeve.

6. The Baby Feeding System of claim 5, wherein the molded shape comprises a molded upper shape and a molded lower shape positioned opposite of the molded upper shape so when juxtaposed the molded shape is illustrative of a shape of a child's interest.

* * * * *